US010354515B2

(12) United States Patent
Lin et al.

(10) Patent No.: US 10,354,515 B2
(45) Date of Patent: Jul. 16, 2019

(54) METHODS AND SYSTEM FOR PROVIDING AN ALARM TRIGGER BYPASS

(71) Applicant: Vivint, Inc., Provo, UT (US)

(72) Inventors: Rongbin Lanny Lin, Orem, UT (US); Brandon Bunker, Highland, UT (US); Aaron Davis, Pleasant Grove, UT (US); Shiwei Liu, Draper, UT (US)

(73) Assignee: Vivint, Inc., Provo, UT (US)

( * ) Notice: Subject to any disclaimer, the term of this patent is extended or adjusted under 35 U.S.C. 154(b) by 32 days.

(21) Appl. No.: 15/215,816

(22) Filed: Jul. 21, 2016

(65) Prior Publication Data

US 2018/0025616 A1 Jan. 25, 2018

(51) Int. Cl.
*G08B 25/00* (2006.01)
*G08B 29/18* (2006.01)

(52) U.S. Cl.
CPC ..... *G08B 25/001* (2013.01); *G08B 29/185* (2013.01)

(58) Field of Classification Search
CPC ..... G08B 13/19602; G08B 29/183; G08B 21/0269; G08B 21/028; G08B 29/185; G06F 1/3231; G06F 3/01; G01P 13/00; G01P 15/00; G01S 5/30
See application file for complete search history.

(56) References Cited

U.S. PATENT DOCUMENTS 6,297,739 B1 10/2001 Small
6,720,876 B1 * 4/2004 Burgess ..... G01S 5/0289 340/10.1
7,424,867 B2 9/2008 Kates
8,786,425 B1 * 7/2014 Hutz ..... H04M 11/04 340/526
2005/0128067 A1 6/2005 Zakrewski
2007/0293186 A1 * 12/2007 Lehmann ..... G08B 13/19621 455/404.2
2008/0001738 A1 * 1/2008 Super ..... G08B 13/19602 340/541
2014/0266669 A1 9/2014 Fadell et al.
2014/0312242 A1 * 10/2014 Valentino ..... G01P 13/00 250/395
2016/0335865 A1 * 11/2016 Sayavong ..... G06F 16/245
2017/0048706 A1 * 2/2017 Kang ..... H04W 12/06
2017/0213447 A1 * 7/2017 Horrocks ..... G08B 19/00

* cited by examiner

*Primary Examiner* — Mirza F Alam
(74) *Attorney, Agent, or Firm* — Holland & Hart LLP

(57) ABSTRACT

A method for security and/or automation systems is described. In one embodiment, the method may include receiving, at a home automation system, data from a detachable broadcasting device indicating an authenticated biosignature, the biosignature being authenticated at the detachable broadcasting device, and the biosignature being associated with an animate object or a mobile inanimate object. The method may further include authenticating the received data, and deriving an alarm bypass instruction based at least in part on the received data. The method may further include detecting a location of the detachable broadcasting device, and communicating the alarm bypass instruction to at least one of a plurality of sensors based at least in part on the detected location of the detachable broadcasting device.

20 Claims, 7 Drawing Sheets

700

METHODS AND SYSTEM FOR PROVIDING AN ALARM TRIGGER BYPASS

BACKGROUND

The present disclosure, for example, relates to a security and/or automation system, and more particularly to deriving an alarm bypass instruction based at least in part on receiving a signal from a detachable broadcasting device, where the detachable broadcasting device has authenticated a biosignature associated with an animate object or a mobile inanimate object.

Home automation systems are widely deployed to provide various types of communication and functional features such as monitoring, communication, notification, and/or others. These systems may be capable of supporting communication with a user through a communication connection or a system management action.

Homeowners with pets often set their security alarm systems to "armed stay" even when they leave their homes, because they fear that their pets could trigger an alarm event based on motion, sound, or video monitoring systems. Similarly, with home mobile robotic devices, such as iRobot® Roombas or the like, becoming more prevalent and moving about homes when the homeowners are away, false alarm triggers caused by the mobile robotic devices are also of concern. However, by setting their systems to "armed stay" rather than "armed away" when the home is unoccupied, homeowners may be limiting the operability of their home security systems by limiting various services available in unoccupied homes, such as smart HVAC systems, vacuuming only when the home is unoccupied, opening/closing blinds, turning lights on/off, etc.

SUMMARY

Existing home security systems have attempted to provide means by which false alarm triggers caused by pets may be avoided by, for example, providing distinctions in motion and video monitoring to coincide with discrepancies between pet sizes and movements, and human sizes and movements. This method, however, is often unreliable. For example, although the distinction between a dog standing in front of a motion or video sensor and a person standing in front of the same sensor may be clear, the system may be less capable of differentiating between a pet standing in front of a sensor and a human sitting or lying down on the floor in front of the same sensor, or in another example, a dog sitting or lying on a couch or bed and a human doing the same. Thus, it may be desirable to provide a more reliable means for differentiating between humans and pets or robots in a home, particularly when the security system is set to "armed away."

Accordingly, in one embodiment, a method for security and/or automation systems is provided. In one embodiment, the method may include receiving, at a home automation system, data from a detachable broadcasting device indicating an authenticated biosignature, the biosignature being authenticated at the detachable broadcasting device, and the biosignature being associated with an animate object or a mobile inanimate object. In one embodiment, the method may further include authenticating the received data, and deriving an alarm bypass instruction based at least in part on the received data. The method may further include detecting a location of the detachable broadcasting device, and communicating the alarm bypass instruction to at least one of a plurality of sensors based at least in part on the detected location of the detachable broadcasting device.

In some embodiments, the method of authenticating the received data may include authenticating the received data against a list of allowed animate or mobile inanimate objects.

In some embodiments, the method of authenticating the received data may further include combining a plurality of the received data to calculate a confidence level, comparing the confidence level to a predetermined confidence threshold parameter, and authenticating the received data based at least in part on the comparing.

In some embodiments, the method of deriving the alarm bypass instruction may include receiving an input providing permission for authenticating the received data. In any embodiment, the permission may include any of temporary permission, permanent permission, or declined permission.

In some embodiments, the method may further include receiving at least one behavioral pattern for the animate object or the mobile inanimate object; deriving the alarm bypass instruction based at least in part on the received at least one behavioral pattern; and communicating the alarm bypass instruction to at least one of the plurality of sensors based at least in part on the detected location of the detachable broadcasting device.

In some embodiments, the received data may include any of a signal, a waveform, a pattern, a sound, an image, or a code associated with the animate object or the mobile inanimate object, or a combination thereof.

In some embodiments, the method may further include receiving the data from the detachable broadcasting device on a continuous basis or at periodic intervals.

In some embodiments, the method may further include updating the alarm bypass instruction based at least in part on detecting an updated location of the detachable broadcasting device.

In some embodiments, the method may further include receiving the biosignature associated with the animate object or the mobile inanimate object at the home automation system; authenticating the received biosignature; deriving the alarm bypass instruction based at least in part on authenticating the received biosignature; detecting a location of the animate object or the mobile inanimate object; and communicating the alarm bypass instruction to at least one of the plurality of sensors based at least in part on the detected location of the animate object or the mobile inanimate object.

In some embodiments, the method may further include providing an alert to one or more user based at least in part on receiving data from the detachable broadcasting device.

The present disclosure is also directed to a method for security and/or automation systems, the method including receiving, at at least one of a plurality of sensors, data from a detachable broadcasting device indicating an authenticated biosignature, the biosignature being authenticated at the detachable broadcasting device, and the biosignature being associated with an animate object or a mobile inanimate object; authenticating the received data; and deriving an alarm bypass instruction based at least in part on the received data.

In some embodiments, the method may further include detecting an unauthenticated biosignature associated with an animate object or a mobile inanimate object; deriving an increased sensitivity instruction based at least in part on the received signal; detecting a location of the animate object or the mobile inanimate object; and communicating the increased sensitivity instruction to at least one of the plurality of sensors based at least in part on the detected location of the animate object or the mobile inanimate object.

In some embodiments, the detachable broadcasting device may be detachably coupled to or carried by the animate object or the mobile inanimate object. In some embodiments, the detachable broadcasting device may be deactivated upon detachment or removal from the animate object or the mobile inanimate object.

In some embodiments, the at least one of the plurality of sensors may be any of a motion sensor, vibration sensor, audio sensor, heat sensor, heartbeat sensor, respiration sensor, or video monitor, or a combination thereof.

The present disclosure is also directed to an apparatus for security and/or automation systems. In some embodiments, the apparatus may include a processor; memory in electronic communication with the processor; and instructions stored in the memory. The instructions may be executable by the processor to receive, at a home automation system, data from a detachable broadcasting device indicating an authenticated biosignature, the biosignature being authenticated at the detachable broadcasting device, and the biosignature being associated with an animate object or a mobile inanimate object; authenticate the received data; derive an alarm bypass instruction based at least in part on the received data; detect a location of the detachable broadcasting device; and communicate the alarm bypass instruction to at least one of a plurality of sensors based at least in part on the detected location of the detachable broadcasting device.

The present disclosure is also directed to an apparatus for security and/or automation systems, the apparatus including a processor; a memory in electronic communication with the processor; and instructions stored in the memory. In one embodiment, the instructions may be executable by the processor to receive, at at least one of a plurality of sensors, data from a detachable broadcasting device indicating an authenticated biosignature, the biosignature being authenticated at the detachable broadcasting device, and the biosignature being associated with an animate object or a mobile inanimate object; authenticate the received data; and derive an alarm bypass instruction based at least in part on the received data.

The present disclosure is also directed to a non-transitory computer-readable medium storing computer-executable code, the code executable by a processor to: receive, at a home automation system, data from a detachable broadcasting device indicating an authenticated biosignature, the biosignature being authenticated at the detachable broadcasting device, and the biosignature being associated with an animate object or a mobile inanimate object; authenticate the received data; derive an alarm bypass instruction based at least in part on the received data; detect a location of the detachable broadcasting device; and communicate the alarm bypass instruction to at least one of a plurality of sensors based at least in part on the detected location of the detachable broadcasting device.

One aspect of the invention relates to systems and methods directed to receiving, at a home automation system, signals from a broadcasting device detachably coupled to a pet, human, or robot, wherein the received signals may result in a security bypass for the pet or robot in a current location of the pet or robot. For example, a broadcasting device may be coupled to or integrated with a pet's collar, or may be attached to or integrated with a mobile robotic device by any known means. The broadcasting device may transmit a signal, such as via Wi-Fi, Bluetooth, RFID, Z-Wave mesh, a 345 device network, or the like, or any other waveform, pattern, sound, image, or code, which may be received by at least one of a plurality of sensors in the immediate area of the broadcasting device. In order to ensure that the alarm bypass is derived based on an approved occupant of the home, the broadcasting device may authenticate a biosignature associated with the pet, human, or robot, prior to transmitting a signal to the home automation device. The signal received by, for example, a sensor in a kitchen, may be transmitted to a component of the home automation system, which may authenticate the signal and provide a bypass instruction to the plurality of sensors located in the kitchen such that no alarm event may be triggered by the presence or motion of the pet, human, or robot having the broadcasting device while present in the kitchen. Because the home automation system "knows" the location of each of the plurality of sensors in the home, the bypass instructions may be directed only to those sensors in the immediate vicinity of the broadcasting device. Thus, by communicating with a single sensor, the broadcasting device may effect a bypass instruction to all sensors in the room or space which the broadcasting device is currently occupying. In some embodiments, the "known" location of the object may be determined to be associated with imminent entrance or exit of the object into or from the home or other structure. The bypass instruction may accordingly be communicated to the appropriate door through which the object is intending to pass.

In some embodiments, the broadcasting device may transmit a signal or data directly to a component of the home automation system, without being received at the one or more sensors. In still other embodiments, the signal or data received at the at least one sensor may be communicated to the other sensors in the immediate area in order to provide a bypass instruction, without input from, for example, a control panel.

The bypass instructions may be applicable only to the immediate space occupied by the pet, human, or robot, such that any motion or other occupancy indicator sensed in other areas of the home, which may be the result of, for example, a burglar break-in or other emergency, may still trigger an alarm event. As the pet, human, or robot moves throughout the home, the signal transmitted by the broadcasting device, either continuously or at regular intervals, may be monitored by the plurality of sensors positioned throughout the home, and may in turn be communicated to the home automation system. In this way, the home automation system may continuously update the bypass instructions throughout the home such that the pet, human, or robot may move freely throughout the home without triggering a false alarm, while still maintaining full alarm security in those portions of the home not currently occupied by the pet, human, or robot. Additionally, in some embodiments, signals or data transmitted from the broadcasting device to at least one of the plurality of sensors in any given room occupied by the broadcasting device may not be operable to bypass perimeter sensors, such as points of entry/exit, outside windows, glass break sensors, and the like, such that the perimeter of the home may still be secured despite the location of the pet, human, or robot inside the home.

In other embodiments, the broadcasting device may be operable, on a limited basis, to bypass perimeter sensors to allow for entry and exit of the pet, human, or robot into and out of the home. For example, a broadcasting device affixed to or integrated with a pet's collar may be operable to open and/or unlock a dog door, such that the pet may be allowed out into the yard or back inside the home when the homeowner is away. During this entry and exit, the home automation system may allow for an alarm trigger bypass of the door entry/exit monitors for the dog door in particular, such that an alarm event is not triggered by the pet's entry or exit. Yet if another animal or person not having the broadcasting device attempts to enter the home through the dog door, no alarm bypass instructions may be received at the plurality of sensors or may be communicated to the home automation system, and an alarm event may be triggered. Similarly, a lawn mowing robotic device, for example, having a broadcasting device affixed thereto, may send signals to sensors on a garage or shed door to allow for opening and closing of the door to allow the lawn mowing robot to mow the lawn while the homeowner is away, and to return to its docking station in the garage or shed when finished, all without triggering any alarm events. Yet motion or barrier sensors at the garage or shed detecting entry or exit of a person not having an authenticated broadcasting device may still trigger an alarm event.

In some embodiments, the broadcasting device may also be utilized as a means to track a pet's location when a homeowner is away. For example, the broadcasting device may send signals to at least one of the plurality of sensors in the home, which may in turn communicate the sensed data to the home automation system. In some embodiments, the broadcasting device may comprise a global positioning system such that the location of the device may be directly communicated to the home automation system without being sensed by at least one of the plurality of sensors. The home automation system may then communicate the pet's location status to the homeowner on, for example, the homeowner's smartphone, indicating that the pet has remained inside the home for eight hours and should be let outside. Upon receiving this information, the homeowner may then return home or contact another person to let the pet outside. In other embodiments, the system may report to the homeowner's smartphone the number of times the pet has gone outside throughout the day.

In other embodiments, the broadcasting device may be utilized to bypass some motion detection functionalities of the home automation system. For example, the broadcasting device may be coupled to a pet's collar, and may send signals to sensors in the yard or outside of the home, which may communicate with the home automation system. The home automation system may then send bypass instructions to, for example, motion-sensing lights in the yard to "ignore" the pet's presence and not turn on when the pet passes by the lights.

While described with respect to pets and robots, the broadcasting device taught herein may also be utilized by human homeowners as a "cloaking device," or "security or privacy veil." For example, the broadcasting device may be configured in the form of a fob, or may be a dedicated application on the homeowner's smartphone, either of which the homeowner may carry with him or attach to himself or his clothing. As the homeowner moves throughout his home, the broadcasting device may transmit signals to at least one of the plurality of sensors positioned throughout the home, which may communicate with the home automation system to provide one or more alarm bypass. The provided bypasses may be preselected by the homeowner. For example, the homeowner may not wish to be recorded by video monitors while in his home, such that, as he moves from room to room, any video monitors in the room which he is presently occupying may be deactivated. Alternatively, or in addition, the homeowner may wish to set his home security system to "armed away" at night or when he is home alone to ensure that all video and motion sensors are activated, but may wish to still be free to move about his home without triggering an alarm event. Thus, the broadcasting device may transmit signals to the plurality of sensors providing for bypass instructions to sensors in the room which he is presently occupying, such that no alarm events are triggered by his presence, but such that the remaining rooms in the home in which the homeowner is not currently present may remain fully armed.

In any embodiment, the broadcasting device may be configured with a safety authentication feature, such that any potential trespassers may not be able to gain access to the device and use the device to bypass the security system. For example, any broadcasting device may include a biosignature sensor, which may detect various biosignature parameters of the human, pet, or robot to which the device is affixed or with which the device is integrated. For example, a broadcasting device affixed to or integrated with a pet's collar may include a biosignature monitor, such that the device may be inoperable, or may not transmit a signal to the plurality of sensors, when not coupled to the approved pet. Alternatively or in addition, the broadcasting device may become deactivated, or may not transmit a signal to the plurality of sensors, upon detachment of the device from the pet's collar, or detachment from a mobile robotic device, for example. The "decision" to deactivate the device based on an impermissible biosignature or upon detachment may be performed by the device itself, or may result from transmitting a signal indicating such impermissible or unauthenticated biosignature or detachment from the device to the home automation system. Upon receiving the signal, the home automation system may direct the device to deactivate. Similarly, a broadcasting device in the form of a fob may be wirelessly linked and authenticated by a homeowner's smartphone, or may be integrated with the smartphone as a dedicated application, such that the broadcasting device may not be operable when in the possession of a user not having the authenticated smartphone, and therefore no alarm bypass instructions may be provided to the plurality of sensors in the home.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

The systems and methods described herein relate to providing a means for bypassing alarm triggers by receiving and authenticating bio signatures at a removable broadcasting device, and transmitting signals from the broadcasting device to a home automation system such that one or more sensors triggered by the presence of an authenticated pet, human, or robot may be bypassed by a bypass instruction from the home automation system.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
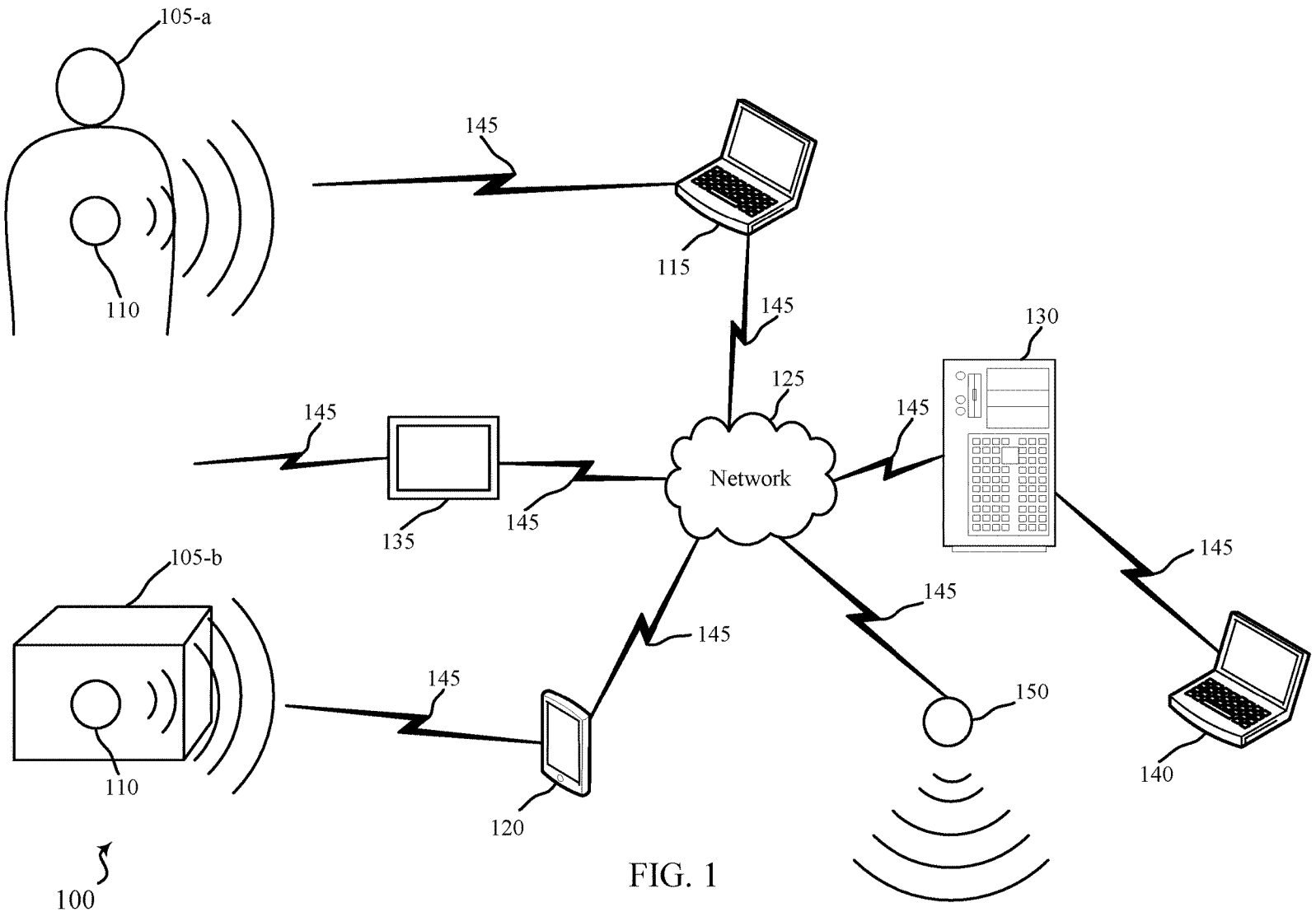
FIG. 1 is a block diagram of an example of a security and/or automation system, in accordance with various embodiments.

FIG. 1 is an example of a home automation system 100 in accordance with various aspects of the disclosure. In some embodiments, the home automation system 100 may include one or more detachable broadcasting devices 110 coupled to any animate object 105-*a* or mobile inanimate object 105-*b*, one or more sensor units 150, a local computing device 115, 120, a network 125, a server 130, a control panel 135, and a remote computing device 140. The network 125 may provide user authentication, encryption, access authorization, tracking, Internet Protocol (IP) connectivity, and other access, calculation, modification, and/or functions. The control panel 135 may interface with the network 125 through wired and/or wireless communication links 145 and may perform communication configuration, adjustment, and/or scheduling for communication with local computing device 115, 120 or remote computing device 140, or may operate under the control of a controller. Control panel 135 may communicate with a backend server 130—directly and/or indirectly—using one or more communication links 145.

The animate object 105-*a* or mobile inanimate object 105-*b* may comprise any of a human, pet, or mobile robotic device. For example, a human animate object 105-*a* may carry or wear a detachable broadcasting device 110. A dog or cat animate object 105-*a* may carry a detachable broadcasting device 110 attached to or integrated with its collar. And a mobile inanimate object 105-*b*, such as an iRobot® Roomba or other mobile robotic device may carry a detachable broadcasting device 110 attached to or integrated with the robotic device.

The control panel 135 may wirelessly communicate via communication links 145 with the local computing device 115, 120 via one or more antennas. The control panel 135 may provide communication coverage for a geographic coverage area. In some examples, control panel 135 may be referred to as a control device, a base transceiver station, a radio base station, an access point, a radio transceiver, a home automation control panel, a smart home panel, a security panel, or some other suitable terminology. The geographic coverage area for control panel 135 may be divided into sectors making up only a portion of the coverage area. The home automation system 100 may include one or more control panels 135 of different types. The control panel 135 may be related to one or more discrete structures (e.g., a home, a business) and each of the one more discrete structures may be related to one or more discrete areas. Control panel 135 may be a home automation system control panel, for example an interactive panel mounted on a wall in a user's home. Control panel 135 may be in direct communication via wired or wireless communication links 145 with the one or more detachable broadcasting devices 110 and one or more sensor units 150, or may receive sensor data from the one or more sensor units 150 via local computing devices 115, 120 and network 125, or may receive data via remote computing device 140, server 130, and network 125.

In any embodiment, detachable broadcasting device 110 may detect a biosignature from animate object 105-*a* or mobile inanimate object 105-*b*, and may authenticate the detected biosignature as being associated with an approved occupant. Detachable broadcasting device may then send a signal to any of a control panel 135 or local computing device 115, 120, or in some embodiments to one or more sensor units 150, indicating an authenticated biosignature associated with the object 105-*a*, 105-*b*. Upon receiving the signal, the control panel 135 or local computing device 115, 120 may derive an alarm bypass instruction based on the received signal, and may communicate the alarm bypass instruction to the one or more sensor units 150 located in the vicinity of the object 105-*a*, 105-*b*, as described in more detail below with respect to FIGS. 2-3.

In some embodiments, control panel 135 may comprise one or more sensor units such that control panel 135 may directly receive signals from a detachable broadcasting device 110. In other embodiments, control panel 135 or local computing device 115, 120 may receive signals from the detachable broadcasting device 110 via one or more sensor unit 150.

The local computing devices 115, 120 may be dispersed throughout the home automation system 100 and each device 115, 120 may be stationary and/or mobile. Local computing devices 115, 120 and remote computing device 140 may be custom computing entities configured to interact with one or more sensor units 150 via network 125, and in some embodiments, via server 130. In other embodiments, local computing devices 115, 120 and remote computing device 140 may be general purpose computing entities. A computing device 115, 120 or 140 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a sensor, and/or the like. A computing device 115, 120 or 140 may also include or be referred to by those skilled in the art as a user device, a sensor, a smartphone, an iPod®, an iPad®, a Bluetooth device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology. A local computing device 115, 120, remote computing device 140, and/or control panel 135 may include and/or be one or more sensors that sense: proximity, motion, temperatures, vibration, humidity, sound level or auditory input, smoke, structural features (e.g., glass breaking, window position, door position), time, geo-location data of a user and/or a device, distance, biometrics, weight, speed, height, size, preferences, light, darkness, weather, time, system performance, heart rate, respiration rate, and/or other inputs that relate to a home automation system. A local computing device 115, 120 may be able to communicate through one or more wired and/or wireless communication links 145 with various components such as control panels, base stations, and/or network equipment (e.g., servers, wireless communication points, etc.) and/or the like.

The communication links 145 shown in home automation system 100 may include uplink (UL) transmissions from a local computing device 115, 120 to a control panel 135, and/or downlink (DL) transmissions from a control panel 135 to a local computing device 115, 120. The communication links 145 may also include uplink and downlink transmissions between the detachable broadcasting devices 110 and the local computing devices 115, 120 and/or control panel 135, and between the local computing devices 115, 120 and/or control panel 135 and the one or more sensor units 150. The downlink transmissions may also be called forward link transmissions while the uplink transmissions may also be called reverse link transmissions. Each communication link 145 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 145 may transmit bidirectional communications and/or unidirectional communications. Communication links 145 may include one or more connections, including but not limited to, 345 MHz, Wi-Fi, Bluetooth, cellular, Z Wave, 802.11, peer-to-peer, LAN, WLAN, Ethernet, fire wire, fiber optic, and/or other connection types related to home automation systems.

In some embodiments of home automation system 100, control panel 135 and/or local computing devices 115, 120 may include one or more antennas for employing antenna diversity schemes to improve communication quality and reliability between control panel 135 and local computing devices 115, 120. Additionally or alternatively, control panel 135 and/or local computing devices 115, 120 may employ multiple-input, multiple-output (MIMO) techniques that may take advantage of multi-path, mesh-type environments to transmit multiple spatial layers carrying the same or different coded data.

While the local computing devices 115, 120 may communicate with each other through the control panel 135 using communication links 145, each local computing device 115, 120 may also communicate directly with one or more other devices via one or more direct communication links 145. Two or more local computing devices 115, 120 may communicate via a direct communication link 145 when both devices 115, 120 are in the geographic coverage area or when one or neither devices 115, 120 is within the geographic coverage area. Examples of direct communication links 145 may include Wi-Fi Direct, Bluetooth, wired, and/or, and other P2P group connections. The devices 115, 120 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within home automation system 100.

In some embodiments, one or more detachable broadcasting device 110 and/or one or more sensor unit 150 may communicate via wired or wireless communication links 145 with one or more of the local computing device 115, 120, control panel 135, or network 125. The network 125 may communicate via wired or wireless communication links 145 with the control panel 135 and the remote computing device 140 via server 130. In alternate embodiments, the network 125 may be integrated with any one of the local computing device 115, 120, server 130, or remote computing device 140, such that separate components are not required. Additionally, in alternate embodiments, one or more sensor units 150 may be integrated with control panel 135, and/or control panel 135 may be integrated with local computing device 115, 120, such that separate components are not required.

The local computing devices 115, 120 and/or control panel 135 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115, 120 and/or control panel 135 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from one or more sensor units 150.

The processor of the local computing devices 115, 120 and/or control panel 135 may be operable to control operation of the output of the local computing devices 115, 120 and/or control panel 135. The output may be a television, a liquid crystal display (LCD) monitor, a cathode ray tube (CRT) monitor, speaker, tactile output device, and/or the like. In some embodiments, the output may be an integral component of the local computing devices 115, 120. Similarly stated, the output may be directly coupled to the processor. For example, the output may be the integral display of a tablet and/or smartphone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115, 120 and/or control panel 135 to the output.

The remote computing device 140 may be a computing entity operable to enable a remote user to monitor the output of the one or more sensor units 150, or to receive a status report or message relating to the derived alarm trigger bypass instructions. The remote computing device 140 may be functionally and/or structurally similar to the local computing devices 115, 120 and may be operable to receive data streams from and/or send signals to at least one of the sensor units 150 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via communication links 145 and server 130.

In some embodiments, the one or more sensor units 150 may be sensors configured to conduct periodic or ongoing automatic measurements related to security and occupancy parameters. Each sensor unit 150 may be capable of sensing multiple occupancy parameters, or alternatively, separate sensor units 150 may monitor separate occupancy parameters. For example, one sensor unit 150 may be a motion sensor, while another sensor unit 150 (or, in some embodiments, the same sensor unit 150) may detect security parameters my monitoring vibration or audio. In some embodiments, one or more sensor units 150 may additionally monitor alternate security and occupancy parameters, for example by monitoring heartbeat or breathing. In alternate embodiments, a user may input occupancy data directly at the local computing device 115, 120 or at remote computing device 140. For example, a user may input at his smartphone or a control panel that he is present in his home and wishes to move about the home without triggering the armed security sensors. In some embodiments, user input relating to occupancy data may be processed in conjunction with occupancy data monitored using one or more sensor units 150.

In some embodiments, the one or more sensor units 150 may be separate from the control panel 135, and may be positioned at various locations throughout the home or property. In other embodiments, the one or more sensor units 150 may be integrated or collocated with home automation system components or home appliances or fixtures. For example, a sensor unit 150 may be integrated with a wall outlet or switch. In still other embodiments, the one or more sensor units 150 may be integrated or collocated with the control panel 135 itself.

Data gathered by the one or more sensor units 150 may be communicated to local computing device 115, 120, which may be, in some embodiments, a thermostat or other wall-mounted input/output home automation system display. In other embodiments, local computing device 115, 120 may be a personal computer or smartphone. Where local computing device 115, 120 is a smartphone, the smartphone may have a dedicated application directed to collecting occupancy and security data and deriving an alarm bypass instruction accordingly. The local computing device 115, 120 may process the data received from the one or more sensor units 150 by comparing the received occupancy data with an alarm trigger bypass instruction derived at the home automation system based on signals received from a detachable broadcasting device. The local computing device 115, 120 may then communicate an alarm bypass instruction to at least one sensor unit 150 positioned near the detachable broadcasting device 110 to enact the alarm trigger bypass instruction. In alternate embodiments, remote computing device 140 may process the data received from the one or more sensor units 150, via network 125 and server 130, to compare the received occupancy data with the derived alarm trigger bypass instruction. Data transmission may occur via, for example, frequencies appropriate for a personal area network (such as Bluetooth or IR communications) or local or wide area network frequencies such as radio frequencies specified by the IEEE 802.15.4 standard.

In some embodiments, local computing device 115, 120 may communicate with remote computing device 140 or control panel 135 via network 125 and server 130. Examples of networks 125 include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 115, 120 from remote computing device 140. For example, in some embodiments, remote computing device 140 may include a mobile application that interfaces with one or more functions of local computing device 115, 120.

The server 130 may be configured to communicate with the sensor units 150, the detachable broadcasting devices 110, the local computing devices 115, 120, the remote computing device 140 and control panel 135. The server 130 may perform additional processing on signals received from the one or more sensor units 150, detachable broadcasting devices 110, and/or local computing devices 115, 120, or may simply forward the received information to the remote computing device 140 and control panel 135.

Server 130 may be a computing device operable to receive data streams (e.g., from one or more sensor units 150, detachable broadcasting devices 110, and/or local computing device 115, 120 or remote computing device 140), store and/or process data, and/or transmit data and/or data summaries (e.g., to remote computing device 140). For example, server 130 may receive a stream of occupancy data based on motion detection from a sensor unit 150, a stream of occupancy data based on respiration monitoring from the same or a different sensor unit 150, and a biosignature authentication signal from a detachable broadcasting device 110. In some embodiments, server 130 may "pull" the data streams, e.g., by querying the sensor units 150, the local computing devices 115, 120, the detachable broadcasting device 110, and/or the control panel 135. In some embodiments, the data streams may be "pushed" from the sensor units 150, detachable broadcasting device 110, and/or the local computing devices 115, 120 to the server 130. For example, the sensor units 150 and/or the local computing device 115, 120 may be configured to transmit data as it is generated by or entered into that device. In some instances, the sensor units 150 and/or the local computing devices 115, 120 may periodically transmit data (e.g., as a block of data or as one or more data points).

The server 130 may include a database (e.g., in memory) containing occupancy data received from the sensor units 150 and/or the local computing devices 115, 120. Additionally, as described in further detail herein, software (e.g., stored in memory) may be executed on a processor of the server 130. Such software (executed on the processor) may be operable to cause the server 130 to monitor, process, summarize, present, and/or send a signal associated with an alarm trigger bypass instruction derived based on received occupancy data from one or more sensor units 150 and signals transmitted from the detachable broadcasting device 110.

Figure 2:
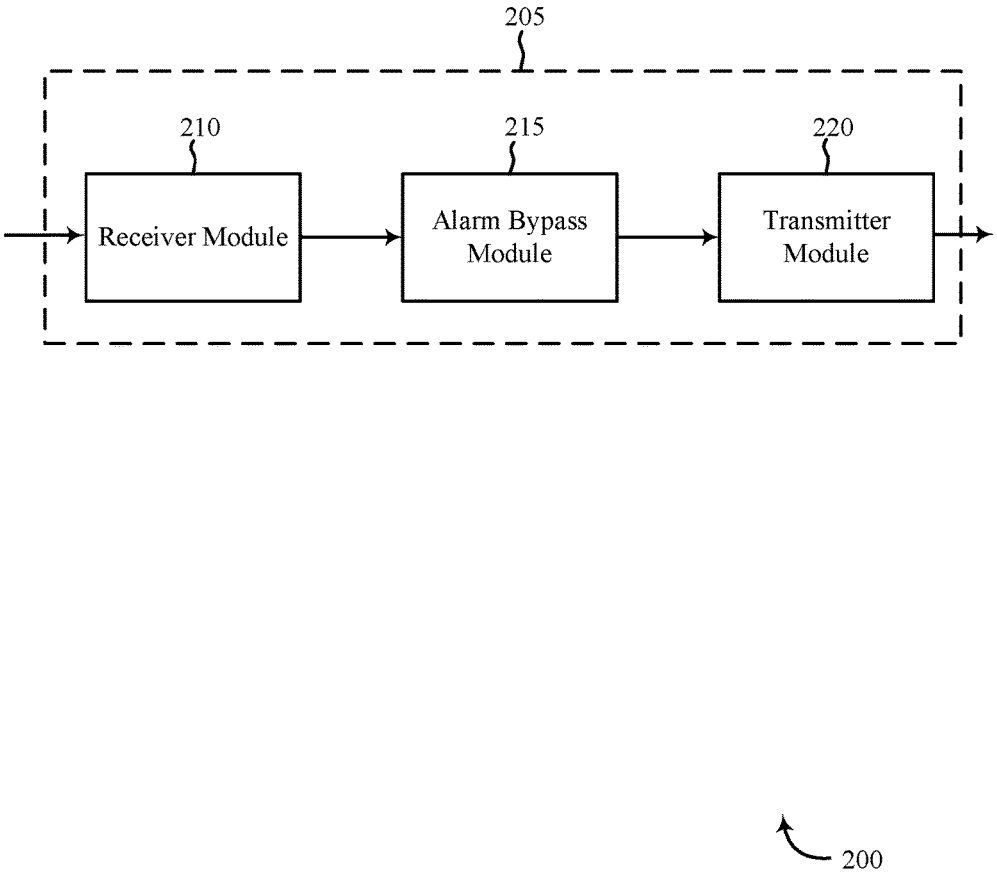
FIG. 2 shows a block diagram of a device relating to a security and/or automation system, in accordance with various aspects of this disclosure.

FIG. 2 shows a block diagram 200 of an apparatus 205 for use in security and/or automation systems, in accordance with various aspects of this disclosure. The apparatus 205 may be, in some embodiments, an example of one or more aspects of a control panel 135, or in other embodiments may be an example of one or more aspects of the one or more sensor units 150, or in still other embodiments may be an example of one or more aspects of the local computing device 115, 120 or remote computing device 140, each of which are described with reference to FIG. 1. The apparatus 205 may include any of a receiver module 210, an alarm bypass module 215, and/or a transmitter module 220. The apparatus 205 may also be or include a processor. Each of these modules may be in communication with each other—directly and/or indirectly.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive occupancy data gathered by one or more sensor unit, and may additionally be configured to receive authenticated biosignature data from the detachable broadcasting device. The received data may include, for example, a signal, a waveform, a pattern, a sound, an image, or a code associated with the animate object or the mobile inanimate object. For example, a motion sensor in a kitchen may detect the presence of an animate object or a mobile inanimate object, and may communicate this occupancy data to the receiver module 210. Additionally, a detachable broadcasting device carried by or integrated with the object may detect a biosignature of the object, may authenticate the biosignature, and may communicate an authenticated biosignature signal associated with the object to the receiver module 210. In other embodiments, occupancy data may be detected by one or more sensor units using various known detection means, such as motion, audio, vibration, heat, heartbeat, respiration, and other sensors. In addition or alternatively, occupancy data may be detected by wireless signals transmitted from a personal computing device such as a smartphone or tablet carried by an occupant, and communicated to the one or more sensor units. In still other embodiments, occupants may input their presence at, for example, a smartphone or control panel, indicating that they are in the home or in a particular room, and that an alarm trigger bypass instruction should be derived based on their presence.

In some embodiments, the detachable broadcasting device may detect and authenticate a biosignature from the animate object or mobile inanimate object with which the detachable broadcasting device is associated. For example, a detachable broadcasting device attached to a collar or worn on a wrist strap may detect a heat signature of a pet or human, and may authenticate that detected heat signature as being associated with an approved occupant of the home. In some examples, this authentication may occur as a result of comparing the received data from the detachable broadcasting device with a list of allowed objects. The detachable broadcasting device may accordingly communicate the authenticated biosignature signal to one or more sensor unit, control panel, or local computing device, where an alarm trigger bypass instruction may be derived. In other embodiments, a biosignature may be detected from an animate object or mobile inanimate object directly at the one or more sensor units, control panel, or local computing device. For example, an audio signature from a mobile vacuuming robotic device may be detected by one or more audio sensor unit, and the audio signature may be authenticated at the one or more sensor unit, or alternatively may be communicated from the audio sensor unit to a control panel or local computing device, which may authenticate the received audio signal to indicate that the source of the audio signature is an approved occupant of the home. In some embodiments, the detected data from the mobile vacuuming robotic device may result in communication of a notification to a remote user to allow for verification and authentication of the device. In some embodiments, the user may provide permanent authentication, while in other embodiments the user may provide temporary permission or may refuse permission or authentication of the device. On the basis of this authentication, an alarm trigger bypass instruction may be derived. In still other embodiments, a biosignature of an animate object or mobile inanimate object may be authenticated at any of a detachable broadcasting device, one or more sensor units, local computing device, or control panel, and may be communicated to a remote computing device via a network. An alarm trigger bypass instruction may accordingly be derived at the remote computing device, and may be communicated to the appropriate one or more sensor units for implementation.

The receiver module 210 may receive the occupancy data and biosignature signal from the one or more sensor units, control panel, or local computing devices. Where apparatus 205 is one or more sensor unit, the monitored occupancy data and biosignature signal may be received at the apparatus 205 and communicated directly to the receiver module 210. In embodiments where apparatus 205 is a control panel, local computing device, or remote computing device, the monitored occupancy data and biosignature signal may be communicated, for example via a wireless communication link, from the one or more sensor unit monitoring the data to the receiver module 210 at apparatus 205.

The occupancy data and biosignature signal received at receiver module 210 may then be communicated to an alarm bypass module 215, which may verify that the biosignature has been authenticated by the detachable broadcasting device in some embodiments, or in other embodiments may locally authenticate the received biosignature signal. Alarm bypass module 215 may then derive an alarm trigger bypass instruction based at least in part on the authenticated biosignature signal. Where an unauthenticated biosignature signal is received or derived, alarm bypass module 215 may alternatively derive an alarm trigger instruction, such that an auditory or visual alarm may be activated, or an alarm signal may be communicated to a central security monitoring station, indicating that an intruder has been detected. Authenticated biosignature information may be inputted by users at any of a local computing device, remote computing device, or control panel, and may be inputted to indicate limited or unlimited user authentication. For example, a user may input a biosignature authentication for a housekeeper who is permitted in the home during daylight hours, but who would be considered an intruder outside of daylight hours. In another example, a user may input a biosignature authentication for a house sitter who is permitted in the home for particular dates, but is no longer permitted after those dates. Other authenticated biosignatures may relate to any combination of humans, pets, or mobile robotic devices, and may permit access to any combination of areas in the home or any combination of dates and/or times. These authenticated biosignature preferences may be maintained on a list of permitted objects or visitors, accessible by the home automation system.

The one or more alarm trigger bypass instructions derived at alarm bypass module 215 may then be communicated to transmitter module 220. Transmitter module 220 may communicate the received alarm bypass instruction derived at alarm bypass module 215 to the appropriate one or more sensor unit in the home or property based on received location data for the detachable broadcasting device, discussed in more detail below with respect to FIG. 3. For example, the alarm bypass instruction may indicate that an approved occupant is in the kitchen, and accordingly the transmitter module 220 may communicate the alarm bypass instruction to all sensor units associated with the kitchen area. In another embodiment, an alarm bypass instruction may indicate that an authenticated biosignature received from the family dog has been received in the backyard at the pet door, and that the dog should be allowed into the home. Accordingly, the transmitter module 220 may communicate the alarm bypass instruction to the perimeter sensor units at and around the dog door, such that the dog may enter the home without triggering security alarms.

Figure 3:
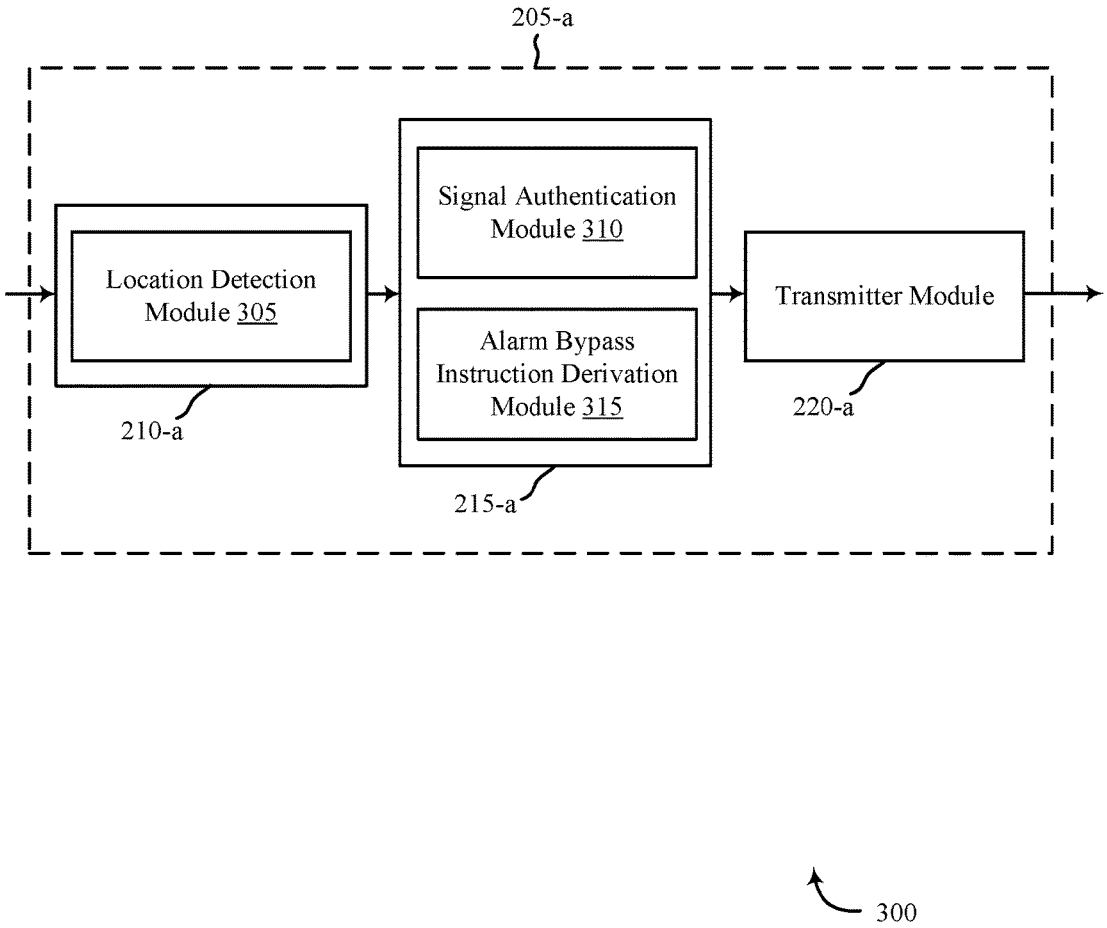
FIG. 3 shows a block diagram of a device relating to a security and/or automation system, in accordance with various aspects of this disclosure.

Apparatus 205-*a*, which may be an example of apparatus 205 illustrated in FIG. 2, is further illustrated in FIG. 3. Apparatus 205-*a* may comprise any of a receiver module 210-*a*, an alarm bypass module 215-*a*, and/or a transmitter module 220-*a*, each of which may be examples of the receiver module 210, the alarm bypass module 215, and the transmitter module 220 as illustrated in FIG. 2. Apparatus 205-*a* may further comprise, as a component of the receiver module 210-*a*, a location detection module 305, and may comprise, as a component of alarm bypass module 215-*a*, any of a signal authentication module 310 and/or an alarm bypass instruction derivation module 315.

The components of apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

In addition to receiving occupancy data and biosignature authentication signals as discussed above with respect to FIG. 2, receiver module 210-*a* may additionally receive location data at location detection module 305 from the detachable broadcasting device indicating a location of the animate object or mobile inanimate object. This location information may be utilized to provide alarm trigger bypass instructions to the appropriate one or more sensor units based on the position of the sensors with respect to the detachable broadcasting device. In this way, the security of the home or property may be maintained in general, while still providing limited alarm trigger bypass instructions to sensor units collocated with the approved occupant. For example, one or more sensor units may detect that a detachable broadcasting device is located in the living room, using any acceptable means such as motion detection or vibration detection. Accordingly, once the biosignature of the object associated with the detachable broadcasting device has been authenticated and an alarm trigger bypass instruction derived, the alarm trigger bypass instruction may be communicated to some or all of the sensor units positioned in the living room, such that the object is free to move about the living room without triggering any security alarms.

In some embodiments, while security alarms such as motion sensors and the like may be temporarily bypassed based on this received instruction, perimeter sensors, such as glass break, door and window, and outdoor motion sensors, may remain activated without a bypass, such that the home remains secure against home invasion attempts. In addition, the location of the detachable broadcasting device, and accordingly the associated animate object or mobile inanimate object, may be updated continuously or at predetermined intervals, such that the appropriate one or more sensor units may receive an alarm trigger bypass instruction based on the object's location in the house. In this way, a person, pet, or robot moving throughout the home or property may not trigger security alarms, yet the portions of the home not currently occupied, or those portions of the home occupied by an unauthorized object, may remain secured.

In some embodiments, occupant location may be inputted directly at apparatus 205-*a*, for example where apparatus 205-*a* is a local computing device or control panel. For example, a user may input at a dedicated application on his smartphone that he is currently in the living room, and may request an alarm trigger bypass for any security sensors in the living room. In some embodiments, the inputted location information may also include user preferences, for example indicating that the user prefers not to be videotaped while in his home. In this way, the alarm trigger bypass may form a "privacy veil" over the user in his home. In other embodiments, the location of the user may be detected automatically. For example, a user waking up in the middle of the night to comfort his crying baby down the hall may be assured that he will not trigger motion alarms by walking down the hall. The one or more sensor units may detect both a biosignature and a location of the user as he leaves his room, and may locally derive an alarm trigger bypass instruction, or may communicate the detected authenticated biosignature and location data to a local computing device or control panel, which may in turn derive the alarm trigger bypass instruction. In other embodiments, the user may carry or wear a detachable broadcasting device, which may locally detect and authenticate the user's biosignature. In still other embodiments, the user's smartphone may serve as a detachable broadcasting device, sending an authenticated bio signature signal to the one or more sensor units.

Apparatus 205-*a* may further comprise, at alarm bypass module 215-*a*, a signal authentication module 310. Signal authentication module 310 may be operable to authenticate a received signal containing a biosignature associated with an animate object or mobile inanimate object. For example, a detachable broadcasting device associated with an object may communicate a signal containing a biosignature detected from the object to the signal authentication module 310. Signal authentication module 310 may accordingly compare the received biosignature signal to a predetermined list of approved occupants, and may authenticate the received signal accordingly. The list of approved occupants may be inputted by the user at a control panel, local computing device, or remote computing device, as previously discussed. In other embodiments, the detachable broadcasting device may authenticate the detected biosignature locally, and may send the authenticated biosignature signal to apparatus 205-*a* to be processed by alarm bypass instruction derivation module 315, without the need to involve signal authentication module 310. In still other embodiments, a biosignature of an object may be detected by apparatus 205-*a* where apparatus 205-*a* is one or more sensor unit, or may alternatively be detected by one or more sensor unit and communicated to apparatus 205-*a* for processing, where apparatus 205-*a* may be any of a control panel, local computing device, or remote computing device. Thus, the biosignature of the object may be authenticated at signal authentication module 310 without the need for signal detection or transmission by a detachable broadcasting device.

In any embodiment, once the biosignature for the object has been authenticated, either at the detachable broadcasting device or at apparatus 205-*a*, the latter of which may comprise any of one or more sensor units, a control panel, or a local or remote computing device, an alarm bypass instruction may be derived by alarm bypass instruction derivation module 315. In some embodiments, alarm bypass instruction derivation module 315 may compare the identity of the received object authentication signal with a predetermined list of alarm bypass preferences inputted by a user. For example, alarm bypass instruction derivation module 315 may receive an authenticated signal for a housekeeper. The user inputted alarm bypass preferences may indicate that motion detectors should be deactivated while the housekeeper is in the home, but that video cameras should remain operational. Accordingly, alarm bypass instruction derivation module 315 may derive an instruction to be communicated to the one or more motion sensor units collocated with the detected housekeeper to bypass any alarms triggered by her presence. As location data for the housekeeper is continuously or periodically updated at location detection module 305, alarm bypass instruction derivation module 315 may derive updated alarm bypass instructions coinciding with the housekeeper's location in the home. For example, as the housekeeper moves from the kitchen to the living room, the alarm bypass instruction derivation module 315 may derive instructions for one or more sensor units positioned in the living room to bypass triggered alarms based on the housekeeper's presence. In addition, as the housekeeper moves to the foyer to exit the home after completing her work, alarm bypass instruction derivation module 315 may derive an instruction to be communicated to one or more front door sensors to bypass any alarms triggered when the housekeeper opens and closes the front door. In this way, the housekeeper may freely enter and the exit the home without the need to know the alarm bypass code, and the home may remain in a secure, "armed away" state even when visitors are expected. In other embodiments, a common alarm bypass instruction may be derived for all detected authenticated occupants.

Alarm bypass instructions derived at alarm bypass instruction derivation module 315 may be communicated to transmitter module 220-*a*, which may disseminate the alarm bypass instructions to the appropriate one or more sensor units based on the location of the animate object or mobile inanimate object. Where apparatus 205-*a* is one or more sensor unit, transmitter module 220-*a* may communicate the instructions locally such that apparatus 205-*a* may bypass any alarms triggered by the presence of the object.

Figure 4:
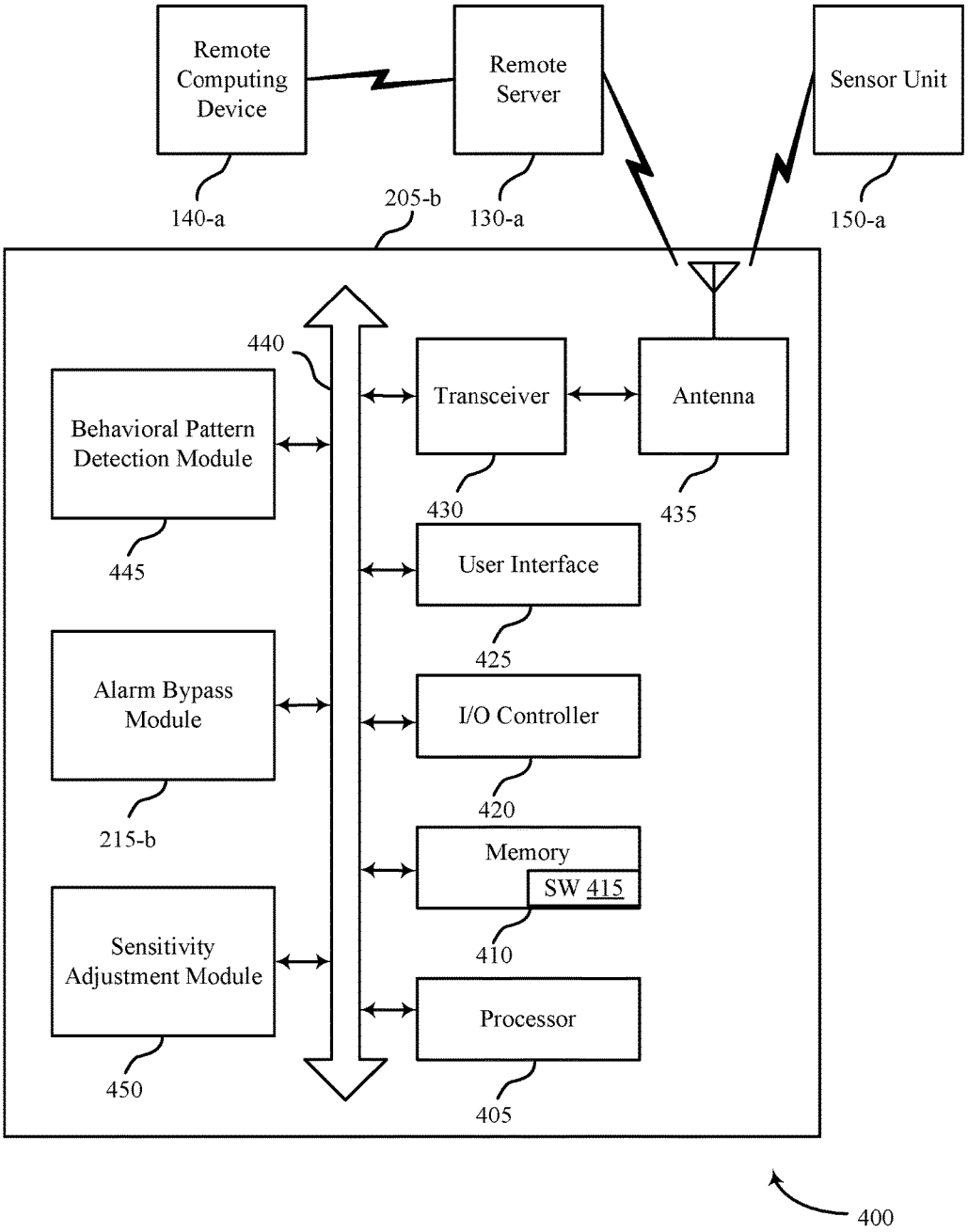
FIG. 4 shows a block diagram relating to a security and/or automation system, in accordance with various aspects of this disclosure.

FIG. 4 shows a system 400 for use in authenticating a biosignature of an animate object or a mobile inanimate object and deriving an alarm bypass instruction, in accordance with various examples. System 400 may include an apparatus 205-*b*, which may be an example of the control panel 135 or one or more sensor unit 150 of FIG. 1. Apparatus 205-*b* may also be an example of one or more aspects of apparatus 205 and/or 205-*a* of FIGS. 2 and 3.

Apparatus 205-*b* may include an alarm bypass module 215-*b*, which may be an example of the alarm bypass module 215, 215-*a* described with reference to FIGS. 2 and 3. Apparatus 205-*b* may also include components for detecting a pattern in object behavior, and for adjusting alarm trigger sensitivity. For example, behavior pattern detection module 445 may be operable to detect a pattern of behavior for an animate object or mobile inanimate object, and may communicate this detected pattern data to alarm bypass module 215-*b* for deriving an alarm bypass instruction. The detected pattern of behavior may provide a means for authenticating an object. For example, where apparatus 205-*b* has observed over time that the family dog enters and exits the home through the dog door during the hours of 7:00 AM and 10:00 PM, behavior pattern detection module 445 may infer that an object identified entering and exiting the home via the dog door during those hours is the approved family dog, whereas an object observed entering the home outside of those hours may be assumed to be an unapproved occupant, and no alarm bypass instruction may be derived. Additionally, detection of unapproved occupants or any otherwise unauthorized visitors may result in communication of an alert or other notification to a remote homeowner or user. The behavior pattern detection may be used in conjunction with or in lieu of biosignature authentication. In this way, were an unauthorized occupant to be mistakenly authenticated based on a biosignature, such as a heat profile, but also identified entering, exiting, or moving about the home at odd hours, an alarm bypass instruction may not be derived, such that an alarm may still be triggered by the occupant's presence.

Apparatus 205-*b* may also comprise a sensitivity adjustment module 450, which may be used to derive an increased sensitivity instruction based at least in part on receiving a signal indicating an unauthenticated biosignature. For example, where an authorized user enters his home with an unauthorized guest, the one or more sensor units may recognize that one biosignature is authorized (that of the user), and that one biosignature is not authorized (that of the guest). Because the user is authorized and is therefore in his home legitimately, it may not be desirable to set off a security alarm. Yet because the authorized user has brought an unauthorized guest, the system may be placed in an increased sensitivity state such that the user may be notified of the location of the unauthorized guest in the home. Thus, sensitivity adjustment module 450, upon receiving the unauthorized biosignature signal, may communicate an increased sensitivity instruction to the one or more sensor units to monitor the unauthorized guest's presence in the home with increased sensitivity. For example, where the unauthorized guest enters various rooms in the authorized user's home, such as a bedroom, any of motion, vibration, or other occupancy detection sensors may be triggered to send a status message to the user at, for example, a control panel or local computing device, indicating the unauthorized guest's location. Upon receiving the status message, the user may provide a manual bypass or allowance for the unauthorized guest's presence in that room. As the system receives these bypass instructions from the authorized user, the system may adaptively "learn" the guest's authorization settings. Thus, when the unauthorized guest enters the home in the future, the sensitivity instruction may be decreased or bypass instructions may be derived for sensor units positioned in rooms in which the guest has been previously approved by the authorized user. In this way, the system may learn user preferences for guest authorizations without the need for the user to manually input particular authorizations for each potential guest.

Apparatus 205-*b* may also include components for bi-directional data communications including components for transmitting communications and components for receiving communications. For example, apparatus 205-*b* may communicate derived alarm bypass instructions or received biosignature signals bi-directionally with one or more sensor units 150-*a*, a remote server 130-*a*, and/or a remote computing device 140-*a*. This bi-directional communication may be direct (e.g., apparatus 205-*b* communicating directly with sensor unit 150-*a*) or indirect (e.g., apparatus 205-*b* communicating with remote computing device 140-*a* via remote server 130-*a*). Remote server 130-*a*, remote computing device 140-*a*, and sensor unit 150-*a* may be examples of remote server 130, remote computing device 140, and sensor unit 150 as shown with respect to FIG. 1.

As previously discussed, the alarm bypass module 215-*b* may receive an authenticated biosignature signal and may derive an alarm bypass instruction based at least in part on the received signal. The derived alarm bypass instruction may then be communicated to the appropriate sensor unit 150-*a*, or may be communicated to remote computing device 140-*a* via remote server 130-*a* for further processing and dissemination. For example, the derived alarm bypass instruction may communicated to a user via remote computing device 140-*a* such that the user may confirm or deny the proposed alarm bypass instruction before the instruction is enacted.

Apparatus 205-*b* may also include a processor module 405, and a memory 410 (including software (SW) 415), an input/output controller module 420, a user interface module 425, a transceiver module 430, and one or more antennas 435, each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of remote server 130-*a* or sensor unit 150-*a*. The transceiver module 430 may include a modem to modulate the packets and provide the modulated packets to the one or more antennas 435 for transmission, and to demodulate packets received from the one or more antennas 435. While an apparatus comprising a control panel (e.g., 205-*b*) may include a single antenna 435, the apparatus may also have multiple antennas 435 capable of concurrently transmitting or receiving multiple wired and/or wireless transmissions. In some embodiments, one element of apparatus 205-*b* (e.g., one or more antennas 435, transceiver module 430, etc.) may provide a direct connection to a remote server 130-*a* via a direct network link to the Internet via a POP (point of presence). In some embodiments, one element of apparatus 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z Wave, cellular network (using 3G and/or LTE, for example), and/or other signals. The one or more antennas 435 and/or transceiver module 430 may include or be related to, but are not limited to, WWAN (GSM, CDMA, and WCDMA), WLAN (including Bluetooth and Wi-Fi), WMAN (WiMAX), antennas for mobile communications, antennas for Wireless Personal Area Network (WPAN) applications (including RFID and UWB). In some embodiments each antenna 435 may receive signals or information specific and/or exclusive to itself. In other embodiments each antenna 435 may receive signals or information neither specific nor exclusive to itself.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of apparatus 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., receive an authenticated biosignature signal, derive an alarm bypass instruction on the basis of the received signal, etc.). Alternatively, the software/firmware code 415 may not be directly executable by the processor module 405 but may cause a computer (e.g., when compiled and executed) to perform functions described herein.

In some embodiments the processor module 405 may include, among other things, an intelligent hardware device (e.g., a central processing unit (CPU), a microcontroller, and/or an ASIC, etc.). The memory 410 may contain, among other things, the Basic Input-Output system (BIOS) which may control basic hardware and/or software operation such as the interaction with peripheral components or devices. For example, the alarm bypass module 215-*b* may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to, or may be included as, one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, bed pad sensor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and is not discussed in detail in this disclosure. Code to implement the present disclosure may be stored in a non-transitory computer-readable medium such as one or more of system memory 410 or other memory. The operating system provided on I/O controller module 420 may be iOS®, ANDROID®, MS-dOS®, MS-WINDOWS®, OS/2®, UNIX®, LINUX®, or another known operating system.

The components of the apparatus 205-*b* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Figure 5:
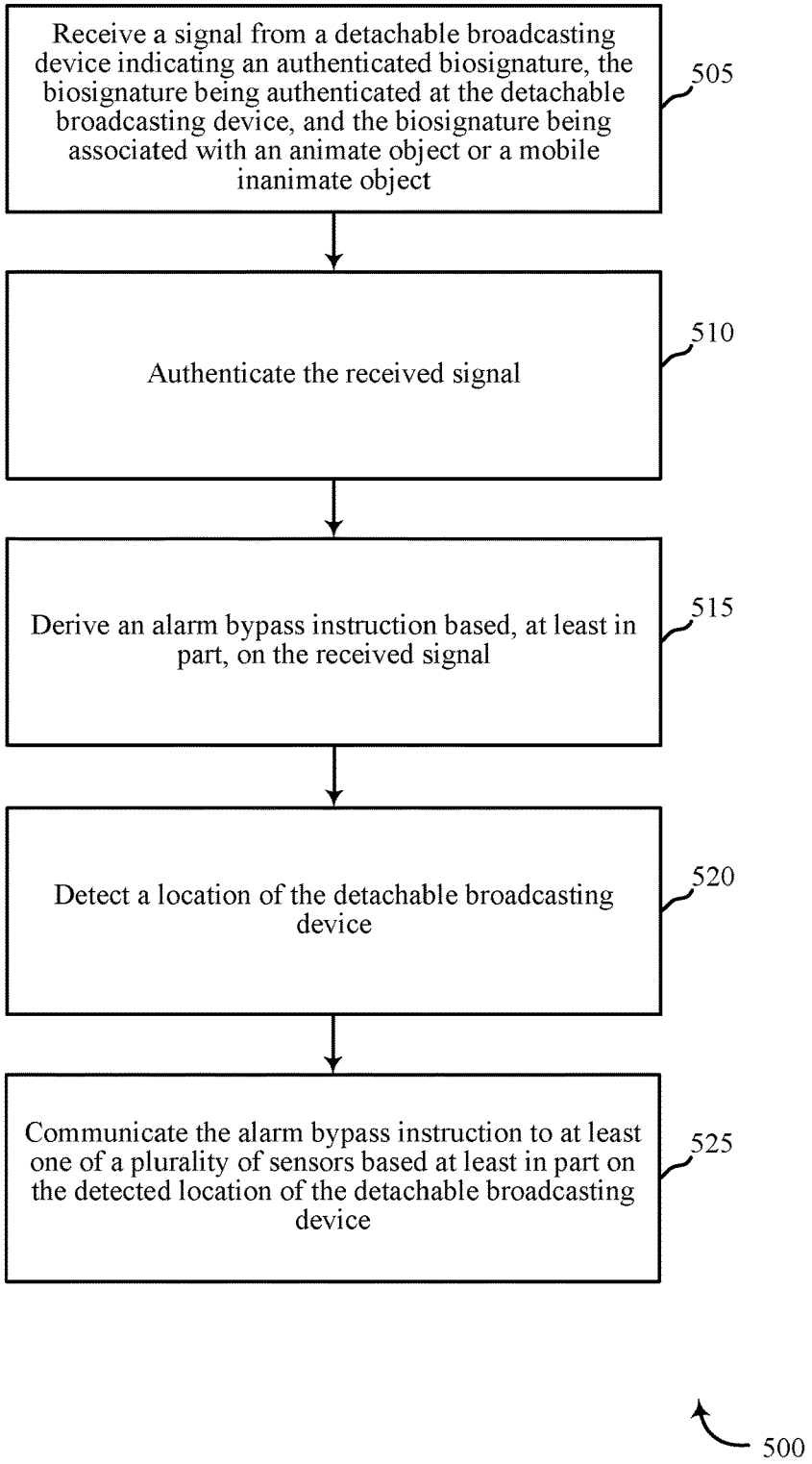
FIG. 5 is a flow chart illustrating an example of a method relating to a security and/or automation system, in accordance with various aspects of this disclosure.

FIG. 5 is a flow chart illustrating an example of a method 500 for security and/or automation systems, in accordance with various embodiments. For clarity, the method 500 is described below with reference to aspects of one or more of the detachable broadcasting devices 110, sensor units 150, local computing device 115, 120, control panel 135, and/or remote computing device 140 described with reference to FIGS. 1-4, and/or aspects of one or more of the apparatus 205, 205-*a*, or 205-*b* described with reference to FIGS. 2-4. In some examples, a detachable broadcasting device, control panel, local computing device, and/or sensor unit may execute one or more sets of codes to control the functional elements described below. Additionally or alternatively, the detachable broadcasting device, control panel, local computing device, and/or sensor unit may perform one or more of the functions described below using special-purpose hardware.

At block 505, the method 500 may include receiving a signal from a detachable broadcasting device indicating an authenticated biosignature, the biosignature being authenticated at the detachable broadcasting device, and the biosignature being associated with an animate object or a mobile inanimate object. As previously discussed, the animate object or mobile inanimate object may include a human, pet, or robot, wherein the object may be wearing, holding, or may have integrated therewith the detachable broadcasting device. For example, the detachable broadcasting device may be attached to a dog's collar, or may be a wrist worn device for a human. The detachable broadcasting device may detect one or more biosignature of the animate or mobile inanimate object, such as a heat or audio profile. The detachable broadcasting device may authenticate the detected biosignature in some embodiments, or in other embodiments a signal associated with the detected biosignature may be communicated to any of one or more sensor unit, control panel, or remote computing device, which may authenticate the received biosignature signal. The detected biosignature may be authenticated by comparing the detected biosignature to a list of user inputted approved occupants. For example, a user may input at a control panel or local computing device preferences relating to approved occupants and, in some cases, approved times for the occupants to occupy the home or property.

In some embodiments, a biosignature associated with an animate object or a mobile inanimate object may be communicated directly to any of one or more sensor units, a control panel, or a local computing device, and may in some examples be further communicated via a network and server to a remote computing device, any of which may authenticate the received biosignature. In such examples, the detachable broadcasting device may not be needed.

At block 510, the method 500 may include authenticating the received signal. The received signal may be authenticated at any of the one or more sensor units, the control panel, the local computing device, or the remote computing device. For example, a biosignature associated with the animate object or mobile inanimate object may have been authenticated at the detachable broadcasting device, but further authentication of the received signal may be required to ensure that the identified object is approved for occupancy in the home or property at that particular time.

At block 515, the method 500 may include deriving an alarm bypass instruction based at least in part on the received signal. The alarm bypass instruction may also be derived at any of the one or more sensor units, control panel, local computing device, or remote computing device. The alarm bypass instruction may be directed to some or all types of sensor units, depending upon received user preferences. For example, upon receiving a signal from the detachable broadcasting device indicating an authenticated biosignature for the family dog at block 505, and authenticating the received signal at 510, an alarm bypass instruction may be derived at block 515 indicating that, depending upon the location of the dog inside or outside the home, various motion and perimeter sensor alarms should be bypassed. Similarly, where a particular user is detected, preferences related to the identified user, such as deactivating video recordings and the like, may be taken into account when deriving the alarm bypass instruction.

At block 520, the method 500 may include detecting a location of the detachable broadcasting device. The location of the detachable broadcasting device may be detected by any known means, for example by using one or more sensor units in the home, receiving motion or vibration data, or receiving wireless signals from the detachable broadcasting device. In other embodiments, a global positioning sensor may be integrated with the detachable broadcasting device indicating and updating its location throughout the home and property. The location of the detachable broadcasting device may be updated on a continuous or periodic basis such that the precise location of the detachable broadcasting device, and therefore the location of the animate object or mobile inanimate object, is known.

At block 525, the method 500 may include communicating the alarm bypass instruction to at least one of a plurality of sensors based at least in part on the detected location of the detachable broadcasting device. In this way, alarm bypass instructions may be communicated with particularity to sensor units that are collocated with the animate object or mobile inanimate object, while maintaining alarm security throughout the remainder of the home or property. As the location of the animate object or mobile inanimate object is continuously or periodically updated, the derived alarm bypass instruction may be communicated to different sensor units in corresponding locations to the object, such that a "security veil" may travel with the object throughout the home or property.

The operations at blocks 505, 510, 515, 520, and 525 may be performed using the receiver module 210, 210-*a*, the alarm bypass module 215, 215-*a*, 215-*b*, the transmitter module 220, 220-*a*, and/or the transceiver module 430, described with reference to FIGS. 2-4.

Thus, the method 500 may provide for alarm bypass deriving methods related to a security and/or automation system. It should be noted that the method 500 is just one implementation and that the operations of the method 500 may be rearranged or otherwise modified such that other implementations are possible.

Figure 6:
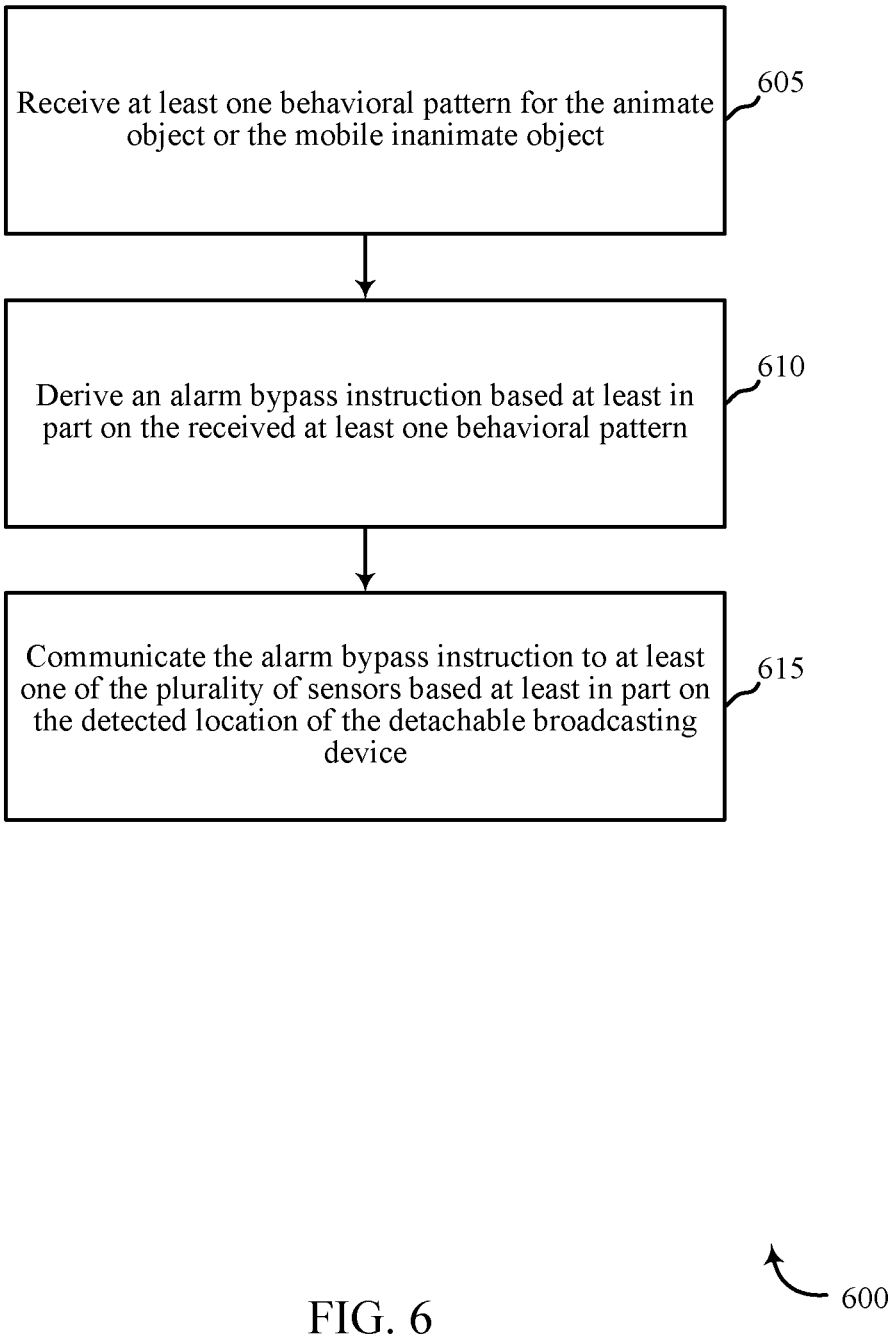
FIG. 6 is a flow chart illustrating an example of a method relating to a security and/or automation system, in accordance with various aspects of this disclosure.

FIG. 6 is a flowchart illustrating an example of a method 600 for deriving an alarm bypass instruction based on detected behavioral patterns, in accordance with various aspects of the present disclosure. For clarity, the method 600 is described below with reference to aspects of one or more of the detachable broadcasting devices 110, sensor units 150, local computing device 115, 120, control panel 135, and/or remote computing device 140 described with reference to FIGS. 1-4, and/or aspects of one or more of the apparatus 205, 205-*a*, or 205-*b* described with reference to FIGS. 2-4. In some examples, a detachable broadcasting device, control panel, local computing device, and/or sensor unit may execute one or more sets of codes to control the functional elements described below. Additionally or alternatively, the detachable broadcasting device, control panel, local computing device, and/or sensor unit may perform one or more of the functions described below using special-purpose hardware.

At block 605, the method 600 may include receiving at least one behavioral pattern for the animate object or the mobile inanimate object. The detected pattern of behavior may provide a means for authenticating the object. For example, where the home automation system has observed over time that the family dog enters and exits the home through the dog door during the hours of 7:00 AM and 10:00 PM, the home automation system may infer that an object identified entering and exiting the home via the dog door during those hours is the approved family dog, whereas an object observed entering the home outside of those hours may be assumed to be an unapproved occupant, and no alarm bypass instruction may be derived. This behavior pattern detection may be used in conjunction with or in lieu of biosignature authentication. In this way, were an unauthorized occupant to be mistakenly authenticated based on a biosignature, such as a heat profile, but also identified entering, exiting, or moving about the home at odd hours, an alarm bypass instruction may not be derived, such that an alarm may still be triggered by the occupant's presence.

At block 610, the method 600 may include deriving an alarm bypass instruction based at least in part on the received at least one behavioral pattern. Thus, where the object is observed entering the home through the dog door during the daylight hours, the home automation system may derive an alarm bypass instruction indicating that motion sensors in the vicinity of the dog door, and perimeter sensors associated with the dog door, should be bypassed for the dog as he enters the home. In some embodiments, this alarm bypass instruction may be derived in conjunction with a received biosignature authentication signal associated with the dog. In other embodiments, the alarm bypass instruction may be derived based solely on the detected pattern.

At block 615, the method 600 may include communicating the alarm bypass instruction to at least one of the plurality of sensors based at least in part on the detected location of the detachable broadcasting device. Thus, the derived alarm bypass instruction indicating the dog should be allowed access to the home via the dog door without triggering an alarm may be communicated to, for example, the motion sensors in the area surrounding the dog door, as well as any perimeter sensors associated with the door itself. As the dog moves through the home, the alarm bypass instructions may be communicated with sensors located near the dog, such that the "security veil" may travel with the dog as he moves throughout the home or property.

Thus, the method 600 may provide for monitoring behavioral patterns for home occupants and deriving alarm bypass instructions accordingly. It should be noted that the method 600 is just one implementation and that the operations of the method 600 may be rearranged or otherwise modified such that other implementations are possible.

Figure 7:
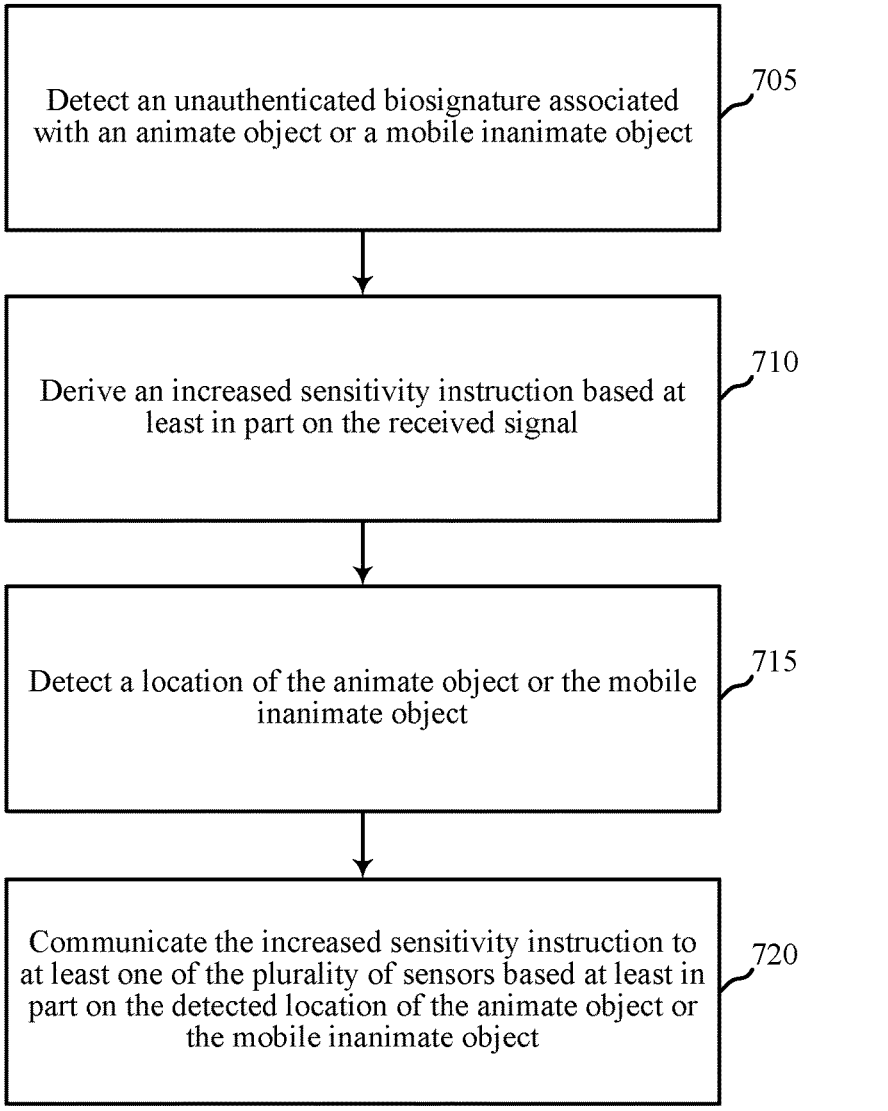
FIG. 7 is a flow chart illustrating an example of a method relating to a security and/or automation system, in accordance with various aspects of this disclosure.

FIG. 7 is a flowchart illustrating an example of a method 700 for increasing a sensitivity instruction based at least in part on a detected unauthenticated biosignature, in accordance with various aspects of the present disclosure. For clarity, the method 700 is described below with reference to aspects of one or more of the detachable broadcasting devices 110, sensor units 150, local computing device 115, 120, control panel 135, and/or remote computing device 140 described with reference to FIGS. 1-4, and/or aspects of one or more of the apparatus 205, 205-*a*, or 205-*b* described with reference to FIGS. 2-4. In some examples, a detachable broadcasting device, control panel, local computing device, and/or sensor unit may execute one or more sets of codes to control the functional elements described below. Additionally or alternatively, the detachable broadcasting device, control panel, local computing device, and/or sensor unit may perform one or more of the functions described below using special-purpose hardware.

At block 705, the method 700 may include detecting an unauthenticated biosignature associated with an animate object or a mobile inanimate object. As previously discussed, one or more sensor units may detect a biosignature of an animate object or a mobile inanimate object by detecting, for example, a heat or audio profile associated with the object, or in some embodiments, by detecting a signal profile where the object is, for example, a mobile robotic device. Where the detected biosignature does not coincide with any approved or authorized occupants according to user inputted occupant preferences, the object associated with the detected biosignature may be deemed unauthorized.

At block 710, the method 700 may include deriving an increased sensitivity instruction based at least in part on the received signal. For example, where an authorized user has entered his home with an unauthorized guest, the one or more sensor units may detect an authenticated biosignature from the unauthorized guest, and may accordingly derive, or forward the signal to any of a control panel, local computing device, or remote computing device for derivation, an increased sensitivity instruction. This increased sensitivity instruction may indicate that the unauthorized guest's movements throughout the home should be closely monitored and reported to the authorized user, for example at a control panel or local computing device. Based on the received reports, the authorized user may then provide approval or a bypass for the unauthorized guest, indicating to the home automation system that the unauthorized guest is permitted in the home in general, or in particular areas of the home specifically.

At block 715, the method 700 may include detecting a location of the animate object or the mobile inanimate object. Thus, using any known occupancy detection means, such as motion or vibration detection, or the like, the one or more sensor units may monitor the unauthorized guest's movement throughout the home. For example, an authorized user may have invited a delivery person into his home, and the delivery person may be permitted, by the user, to be in the foyer and living room of the home, but may not be approved to be in other areas of the home, such as the bedrooms. Accordingly, the one or more sensor units may detect the location of the delivery person such that the authorized user may be alerted of the delivery person's unauthorized movement into other areas of the home.

At block 720, the method 700 may include communicating the increased sensitivity instruction to at least one of the plurality of sensors based at least in part on the detected location of the animate object or the mobile inanimate object. For example, based on the detection that the unauthorized guest is in the kitchen, the increased sensitivity instruction may be communicated to the one or more sensor units positioned in the kitchen. As the unauthorized guest moves throughout the home, the increased sensitivity instruction may be communicated to various sensor units positioned in locations corresponding to the unauthorized guest's location in the home or property. In this way, the home automation system may monitor the movement of the unauthorized guest throughout the home and may update the authorized user on these movements.

In some embodiments, the home automation system may adaptively "learn" the authorized user's preferences with respect to various unauthorized guests based on the user's response to the status updates received at the control panel or local computing device regarding the unauthorized guest's movements. For example, where an authorized user has invited a friend home for dinner, the unauthorized biosignature of the unauthorized guest may be detected by one or more sensor units, and an increased sensitivity instruction may be derived and communicated to the appropriate sensor units based on the unauthorized biosignature and corresponding location of the unauthorized guest. As the unauthorized guest moves through the home, alerts may be communicated to the authorized user indicating, for example at a smartphone, that the unauthorized guest has entered the dining room. The authorized user may input at his smartphone confirmation that the unauthorized guest is permitted in the dining room. On this basis, when the unauthorized guest returns to the home at a later date, the home automation system may derive a lesser sensitivity instruction, or may derive an alarm bypass instruction, for the unauthorized guest with respect to rooms which have been approved by the authorized user, such as the dining room. However, where the unauthorized guest enters a bedroom, for which the authorized user has not previously provided authorization, an alert may be communicated to the authorized user indicating the unauthorized guest's presence in that room.

Thus, the method 700 may provide for adaptively updating sensitivity instructions of one or more sensor units based on detected unauthorized biosignatures. It should be noted that the method 700 is just one implementation and that the operations of the method 700 may be rearranged or otherwise modified such that other implementations are possible.

In some examples, aspects from two or more of the methods 500, 600, 700 may be combined and/or separated. It should be noted that the methods 500, 600, 700 are just example implementations, and that the operations of the methods 500-700 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, comprising:

receiving, at a home automation system, data from a first detachable broadcasting device indicating an authenticated biosignature, the biosignature being authenticated at the first detachable broadcasting device, and the biosignature being associated with a first animate object or a first mobile inanimate object;

receiving, at the home automation system, data from a second detachable broadcasting device indicating an unauthenticated biosignature associated with a second animate object or a second mobile inanimate object;

authenticating the data received from the first detachable broadcasting device based at least in part on the biosignature;

deriving a first alarm bypass instruction comprising at least one authentication parameter associated with the first animate object or the first mobile inanimate object based at least in part on the data received from the first detachable broadcasting device, the first alarm bypass instruction being derived based at least in part on the biosignature being authenticated at the first detachable broadcasting device;

detecting a location of the first detachable broadcasting device and a real-time location of the second detachable broadcasting device;

deriving a second alarm bypass instruction having an increased sensitivity instruction based at least in part on detecting the real-time location of the second detachable broadcasting device, wherein the increased sensitivity instruction comprises at least one authentication parameter different than the authentication parameter associated with the first alarm bypass instruction; and communicating the first alarm bypass instruction and the second alarm bypass instruction to at least one of a plurality of sensors based at least in part on the detected location of the first detachable broadcasting device and the real-time location of the second detachable broadcasting device.

2. The method of claim 1, authenticating the received data comprising:

authenticating the received data against a list of allowed animate or mobile inanimate objects.

3. The method of claim 1, authenticating the received data further comprising:

combining a plurality of the received data to calculate a confidence level;

comparing the confidence level to a predetermined confidence threshold parameter; and authenticating the received data based at least on the comparing.

4. The method of claim 1, deriving the alarm bypass instruction comprising:

receiving an input providing permission for authenticating the received data, wherein the permission comprises any of temporary permission, permanent permission, or declined permission.

5. The method of claim 1, further comprising:

receiving at least one behavioral pattern for the animate object or the mobile inanimate object;

deriving the alarm bypass instruction based at least in part on the received at least one behavioral pattern; and communicating the alarm bypass instruction to at least one of the plurality of sensors based at least in part on the detected location of the detachable broadcasting device.

6. The method of claim 1, the received data comprising any of a signal, a waveform, a pattern, a sound, an image, or a code associated with the animate object or the mobile inanimate object, or a combination thereof.

7. The method of claim 1, further comprising:

receiving the data from the detachable broadcasting device on a continuous basis or at periodic intervals.

8. The method of claim 1, further comprising:

updating the alarm bypass instruction based at least in part on detecting an updated location of the detachable broadcasting device.

9. The method of claim 1, further comprising:

receiving the biosignature associated with the animate object or the mobile inanimate object at the home automation system;

authenticating the received biosignature;

deriving the alarm bypass instruction based at least in part on authenticating the received biosignature;

detecting a location of the animate object or the mobile inanimate object; and communicating the alarm bypass instruction to at least one of the plurality of sensors based at least in part on the detected location of the animate object or the mobile inanimate object.

10. The method of claim 1, further comprising:

providing an alert to one or more user based at least in part on receiving data from the detachable broadcasting device.

11. A method for security and/or automation systems, comprising:

receiving, at at least one of a plurality of sensors, data from a first detachable broadcasting device indicating an authenticated biosignature, the biosignature being authenticated at the first detachable broadcasting device, and the biosignature being associated with a first animate object or a first mobile inanimate object;

receiving, at the at least one of the plurality of sensors, data from a second detachable broadcasting device indicating an unauthenticated biosignature associated with a second animate object or a second mobile inanimate object;

authenticating the data received from the first detachable broadcasting device based at least in part on the biosignature;

deriving a first alarm bypass instruction comprising at least one authentication parameter associated with the first animate object or the first mobile inanimate object based at least in part on the data received from the first detachable broadcasting device, the first alarm bypass instruction being derived based at least in part on the biosignature being authenticated at the first detachable broadcasting device; and deriving a second alarm bypass instruction having an increased sensitivity instruction based at least in part on detecting a real-time location of the second detachable broadcasting device, wherein the increased sensitivity instruction comprises at least one authentication parameter different than the authentication parameter associated with the first alarm bypass instruction.

12. The method of claim 11, further comprising:

communicating the second alarm bypass instruction having the increased sensitivity instruction to at least one of the plurality of sensors based at least in part on the detected real-time location of the second animate object or the second mobile inanimate object.

13. The method of claim 11, wherein the detachable broadcasting device is detachably coupled to or carried by the animate object or the mobile inanimate object.

14. The method of claim 13, wherein the detachable broadcasting device is deactivated upon detachment or removal from the animate object or the mobile inanimate object.

15. The method of claim 11, wherein the at least one of the plurality of sensors is any of a motion sensor, vibration sensor, audio sensor, heat sensor, heartbeat sensor, respiration sensor, or video monitor, or a combination thereof.

16. An apparatus for security and/or automation systems, comprising:

a processor;

memory in electronic communication with the processor; and instructions stored in the memory, the instructions being executable by the processor to:

receive, at a home automation system, data from a first detachable broadcasting device indicating an authenticated biosignature, the biosignature being authenticated at the first detachable broadcasting device, and the biosignature being associated with first animate object or a first mobile inanimate object;

receive, at the home automation system, data from a second detachable broadcasting device indicating an unauthenticated biosignature associated with a second animate object or a second mobile inanimate object;

authenticate the data received from the first detachable broadcasting device based at least in part on the biosignature;

derive a first alarm bypass instruction comprising at least one authentication parameter associated with the first animate object or the first mobile inanimate object based at least in part on the data received from the first detachable broadcasting device, the first alarm bypass instruction being derived based at least in part on the biosignature being authenticated at the first detachable broadcasting device;

detect a location of the first detachable broadcasting device and a real-time location of the second detachable broadcasting device;

derive a second alarm bypass instruction having an increased sensitivity instruction based at least in part on detecting the real-time location of the second detachable broadcasting device, wherein the increased sensitivity instruction comprises at least one authentication parameter different than the authentication parameter associated with the first alarm bypass instruction; and communicate the first alarm bypass instruction and the second alarm bypass instruction to at least one of a plurality of sensors based at least in part on the detected location of the first detachable broadcasting device and the real-time location of the second detachable broadcasting device.

17. The apparatus of claim 16, wherein the processor is further configured to:

receive at least one behavioral pattern for the animate object or the mobile inanimate object;

derive the alarm bypass instruction based at least in part on the received at least one behavioral pattern; and communicate the alarm bypass instruction to at least one of the plurality of sensors based at least in part on the detected location of the detachable broadcasting device.

18. An apparatus for security and/or automation systems, comprising:

a processor;

memory in electronic communication with the processor; and instructions stored in the memory, the instructions being executable by the processor to:

receive, at at least one of a plurality of sensors, data from a first detachable broadcasting device indicating an authenticated biosignature, the biosignature being authenticated at the first detachable broadcasting device, and the biosignature being associated with a first animate object or a first mobile inanimate object;

receive, at the at least one of the plurality of sensors, data from a second detachable broadcasting device indicating an unauthenticated biosignature associated with a second animate object or a second mobile inanimate object;

authenticate the data received from the first detachable broadcasting device based at least in part on the biosignature;

derive a first alarm bypass instruction comprising at least one authentication parameter associated with the first animate object or the first mobile inanimate object based at least in part on the data received from the first detachable broadcasting device, the first alarm bypass instruction being derived based at least in part on the biosignature being authenticated at the first detachable broadcasting device; and derive a second alarm bypass instruction having an increased sensitivity instruction based at least in part on detecting a real-time location of the second detachable broadcasting device, wherein the increased sensitivity instruction comprises at least one authentication parameter different than the authentication parameter associated with the first alarm bypass instruction.

19. The apparatus of claim 18, wherein the processor is further configured to:

communicate the second alarm bypass instruction having the increased sensitivity instruction to at least one of the plurality of sensors based at least in part on the detected real-time location of the second animate object or the second mobile inanimate object.

20. A non-transitory computer-readable medium storing computer-executable code, the code executable by a processor to:

receive, at a home automation system, data from a first detachable broadcasting device indicating an authenticated biosignature, the biosignature being authenticated at the first detachable broadcasting device, and the biosignature being associated with first animate object or a first mobile inanimate object;

receive, at the home automation system, data from a second detachable broadcasting device indicating an unauthenticated biosignature associated with a second animate object or a second mobile inanimate object;

authenticate the data received from the first detachable broadcasting device based at least in part on the biosignature;

derive a first alarm bypass instruction comprising at least one authentication parameter associated with the first animate object or the first mobile inanimate object based at least in part on the data received from the first detachable broadcasting device, the first alarm bypass instruction being derived based at least in part on the biosignature being authenticated at the first detachable broadcasting device;

detect a location of the first detachable broadcasting device and a real-time location of the second detachable broadcasting device;

derive a second alarm bypass instruction having an increased sensitivity instruction based at least in part on detecting the real-time location of the second detachable broadcasting device, wherein the increased sensitivity instruction comprises at least one authentication parameter different than the authentication parameter associated with the first alarm bypass instruction; and communicate the first alarm bypass instruction and the second alarm bypass instruction to at least one of a plurality of sensors based at least in part on the detected location of the first detachable broadcasting device and the real-time location of the second detachable broadcasting device.

* * * * *